US008862043B2

(12) United States Patent
Ikebata et al.

(10) Patent No.: US 8,862,043 B2
(45) Date of Patent: Oct. 14, 2014

(54) TONER TRANSPORTING DEVICE AND IMAGE FORMING APPARATUS INCLUDING TONER TRANSPORTING DEVICE

(71) Applicants: Yoshiaki Ikebata, Osaka (JP); Kenichi Hayashi, Osaka (JP)

(72) Inventors: Yoshiaki Ikebata, Osaka (JP); Kenichi Hayashi, Osaka (JP)

(73) Assignee: Kyocera Document Solutions Inc. (JP)

( * ) Notice: Subject to any disclaimer, the term of this patent is extended or adjusted under 35 U.S.C. 154(b) by 42 days.

(21) Appl. No.: 13/660,118

(22) Filed: Oct. 25, 2012

(65) Prior Publication Data

US 2013/0108341 A1 May 2, 2013

(30) Foreign Application Priority Data

Oct. 27, 2011 (JP) ..... 2011-236010
Nov. 28, 2011 (JP) ..... 2011-259212

(51) Int. Cl.
*G03G 21/10* (2006.01)

(52) U.S. Cl.
CPC ..... *G03G 21/105* (2013.01); *G03G 2215/0827* (2013.01)
USPC ..... 399/358; 399/256

(58) Field of Classification Search
CPC ..... G03G 2221/1624
USPC ..... 399/256, 360
See application file for complete search history.

(56) References Cited

U.S. PATENT DOCUMENTS 5,510,881 A * 4/1996 Smith et al. ..... 399/257
2013/0266344 A1* 10/2013 Leemhuis et al. ..... 399/256

FOREIGN PATENT DOCUMENTS

| | | | |
|---|---|---|---|
| JP | 63-174366 | | 11/1998 |
| JP | 11-327397 | | 11/1999 |
| JP | 2000-181315 | | 6/2000 |
| JP | 2007034340 | A * | 2/2007 |
| JP | 2007-249123 | | 9/2007 |
| JP | 2008-158168 | | 7/2008 |
| JP | 2008-158170 | | 7/2008 |
| JP | 2009-109830 | | 5/2009 |
| JP | 2011-095357 | | 5/2011 |
| JP | 2012058521 | A * | 3/2012 |

OTHER PUBLICATIONS

Search Report dated Feb. 13, 2013 issued in corresponding European Patent Application No. 12189702.9 with English translation.

* cited by examiner

*Primary Examiner* — Clayton E LaBalle
*Assistant Examiner* — Leon W Rhodes, Jr.
(74) *Attorney, Agent, or Firm* — Ostrolenk Faber LLP

(57) ABSTRACT

A toner transporting device includes a screw that includes a spiral fin wound around a shaft portion and transports toner in the axial direction, and a toner crushing member that is disposed along the transport direction of the toner and crushes accumulated toner, wherein the toner crushing member includes a base portion that extends along the shaft portion of the screw, and a flexible plate member which is disposed at a position in which the flexible plate member bumps into and contacts the fin, and in which the downstream side in the transport direction of the toner in the screw is fixed to the base portion and the upstream side is separated from the base portion.

14 Claims, 10 Drawing Sheets

TONER TRANSPORTING DEVICE AND IMAGE FORMING APPARATUS INCLUDING TONER TRANSPORTING DEVICE

BACKGROUND OF THE DISCLOSURE

Priority is claimed on Japanese Patent Application No. 2011-236010, filed on Oct. 27, 2011 and Japanese Patent Application No. 2011-259212, filed on Nov. 28, 2011, the contents of which are incorporated herein by reference.

FIELD OF THE DISCLOSURE

The present disclosure relates to a toner transporting device and an image forming apparatus including the toner transporting device.

DESCRIPTION OF RELATED ART

Conventionally, an imaging forming apparatus includes a toner transporting device, for example, the toner transporting device transports toner which is scraped from a photoreceptor (image carrier) by a cleaning blade, and the toner is collected as waste toner.

The toner transporting device includes a screw that has a fin spirally wound around a shaft portion, the screw is rotated, and thereby, the toner is transported in the axial direction of the screw.

By the way, when the image forming apparatus is used for a long time, the toner is accumulated around the screw, and a transportation path is narrowed due to the accumulated toner.

If the transportation path of the toner is narrowed in this way, smooth transportation of the toner is not possible.

As a result, an accumulated amount per unit time of the toner exceeds the transportation amount per unit time of the screw, and the toner may be leaked to the periphery.

In order to prevent the transporting path from being narrowed due to the toner, a method which applies a vibration to the screw and crushes the accumulated toner is known.

In addition, a method is known in which a rectangular elastic sheet is disposed in a position at which the rectangular elastic sheet bumps into and contacts the fin of the screw, the elastic sheet is swung due to movement of the fin, and the accumulated toner is crushed due to the swing.

However, in the method which applies a vibration to the screw and crushes the accumulated toner, a striking mechanism for applying the vibration to the screw is required, and thereby, the configuration is complicated and the apparatus cost increases.

On the other hand, in the method which sheet swings the elastic due to movement of the fin, and crushes the accumulated toner due to the swing, since the elastic sheet is repeatedly swung in only the diameter direction of the screw, advance of the toner which is to move in the axial direction of the screw is inhibited.

Therefore, there is a problem in that transportability of the toner decreases.

In addition, in case that the above-described elastic sheet are disposed in the above position, since the supply path to the screw is narrowed due to the elastic sheet, the movement of the toner to the screw is inhibited.

As a result, the toner supply amount to the screw per unit time decreases and the transportability of the toner decreases.

Moreover, in order to prevent the decrease of the toner supply amount, disposing the elastic sheets so as to be largely separated from each other is considered.

However, in this case, the toner is not crushed at a region in which the elastic sheet is not present, and the region where the toner is crushed becomes localized.

An object of the present disclosure is capable of crushing accumulated toner without requiring a complicated mechanism such as a striking mechanism and decreasing transportability of the toner in a toner transporting device and an image forming apparatus including the toner transporting device, and is capable of crushing the accumulated toner over a wide range while suppressing the decrease of the transportability of the toner in the toner transporting device and the image forming apparatus including the toner transporting device.

SUMMARY OF THE DISCLOSURE

According to a first aspect of the present disclosure, there is provided a toner transporting device including: a screw that includes a spiral fin wound around a shaft portion and transports toner in the axial direction thereof; and a toner crushing member that is disposed along the transport direction of the toner and crushes accumulated toner. Also, the toner crushing member includes: a base portion that extends along the shaft portion of the screw; and a flexible plate member which is disposed at a position at which the flexible plate member bumps into and contacts the fin, and in which the downstream side of the flexible plate member in the transport direction of the toner in the screw is fixed to the base portion and the upstream side of the flexible plate member in the transport direction of the toner in the screw is separated from the base portion.

According to a second aspect of the present disclosure, there is provided a toner transporting device including: a screw that includes a spiral fin wound around a shaft portion and transports toner in the axial direction; and a toner crushing member that is disposed along the transport direction of the toner and crushes accumulated toner, wherein the toner crushing member includes: a base portion that extends along the shaft portion of the screw; and a flexible plate member that is disposed at a position at which the flexible plate member bumps into and contacts the fin, and includes a root portion which is fixed to the base portion and a tip portion at which the width in the transport direction of the toner in the screw is wider than the width of the root portion.

DETAILED DESCRIPTION OF THE DISCLOSURE

First Embodiment

Figure 1:
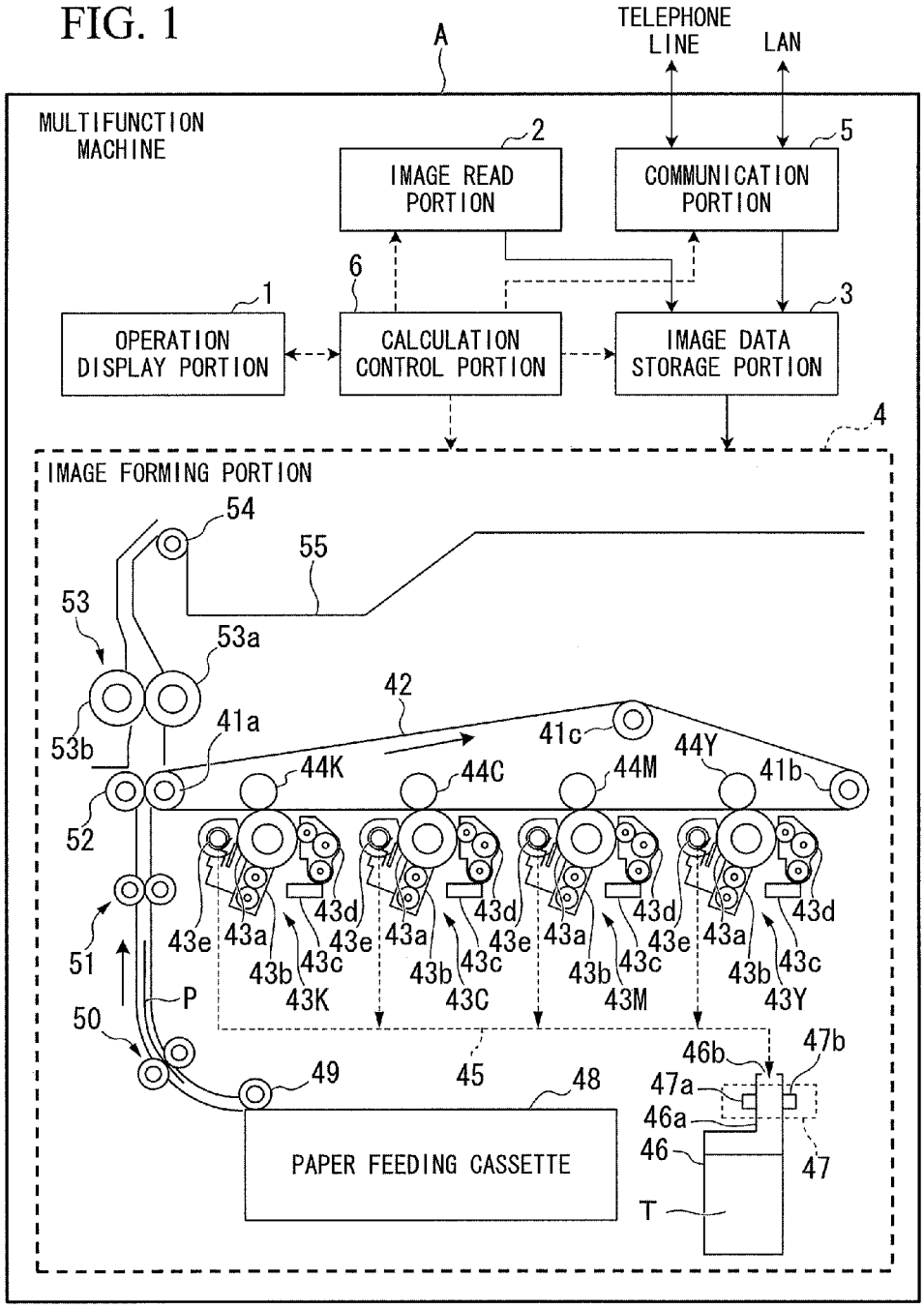
FIG. 1 is a longitudinal cross-sectional view schematically showing an outline configuration of a multifunction machine in an embodiment of the present disclosure.

Hereinafter, a first embodiment of an image forming apparatus according to the present disclosure will be described with reference to the drawings.

Moreover, in the drawings below, the scale of each member is appropriately changed for the size of each member to be recognizable.

FIG. 1 is a longitudinal cross-sectional view schematically showing an outline configuration of a multifunction machine A (image forming apparatus) of a first embodiment of the present disclosure.

The multifunction machine A of the present embodiment is an image forming apparatus which performs image forming based on an electrophotographic method. As shown in FIG. 1, the multifunction machine A includes an operation display portion 1, an image read portion 2, an image data storage portion 3, an image forming portion 4, a communication portion 5, and a calculation control portion 6.

The operation display portion 1 includes operation keys and a touch panel and functions as a man-machine interface which connects a user and the multifunction machine A.

The operation display portion 1 outputs operation instructions of the user with respect to operation buttons displayed on the operation keys or the touch panel to the calculation control portion 6 as operation signals. The operation display portion 1 displays various kinds of information on the touch panel based on control signals input from the calculation control portion 6.

The image read portion 2 reads a surface image (document image) of a document which is automatically fed using an ADF (Automatic Document Feeder) or a document which is disposed on a platen glass based on the control signals input from the calculation control portion 6 using a line sensor, and the image read portion 2 converts the read surface image to document image data. Also, the image read portion 2 outputs the document image data to the image data storage portion 3.

The image data storage portion 3 is a semiconductor memory, a hard disk drive, or the like, and stores the document image data, printer image data where the communication portion 5 receives an outside client computer, and a facsimile image data where the communication portion 5 receives an outside facsimile device based on the control signals input from the calculation control portion 6.

In addition, the image data storage portion 3 reads the image data and outputs the image data to the image forming portion 4.

The image forming portion 4 forms the toner image based on the image data read from the image data storage portion 3 on a recording paper P taken out from a paper feeding cassette 48 based on the control signals input from the calculation control portion 6.

As shown in FIG. 1, the image forming portion 4 includes a belt roller 41, an intermediate transfer belt 42, four imaging forming units 43Y,43M, 43C, and 43K corresponding to each color (Y, M, C, and K) of the toner, primary transfer rollers 44Y, 44M, 44C, and 44K, a waste toner transport portion 45, a waste toner bottle 46, a full detecting sensor 47, a paper feeding cassette 48, a pickup roller 49, a transport roller 50, a register roller 51, a secondary transfer roller 52, a pair of fixing rollers 53, a paper discharging roller 54, and a paper discharging tray 55.

As shown in FIG. 1, the belt roller 41 includes three rollers that are separated from one another and are disposed, that is, a driving roller 41*a*, a driven roller 41*b*, and a tension roller 41*c*.

That is, the driving roller 41*a* and the driven roller 41*b* are disposed so as to be separated at a constant distance in the horizontal direction. The tension roller 41*c* is disposed at a position which is between the driving roller 41*a* and the driven roller 41*b* and is displaced slightly above the rollers 41*a* and 41*b*.

The intermediate transfer belt 42 is an endless belt which is suspended over the belt roller 41 (driving roller 41*a*, driven roller 41*b*, and tension roller 41*c*), and the intermediate transfer belt 42 travels in a direction shown by an arrow in FIG. 1 by the driving roller 41*a*.

That is, the intermediate transfer belt 42 travels in the horizontal direction between the driving roller 41*a* and the driven roller 41*b*.

Moreover, the above-described driving roller 41*a* is a roller which is connected to the shaft of a motor which generates a driving force, and the driving roller 41*a* travels the intermediate transfer belt 42 in the arrow direction by the power of the motor.

The driven roller 41*b* is a free roller which is provided so as to freely rotate.

Additionally, the rotation shaft of the tension roller 41*c* is provided so as to be moved.

Accordingly, the tension roller 41*c* presses the intermediate transfer belt 42 with a predetermined tension, and thereby, constant tension can be applied to the intermediate transfer belt 42.

As shown in FIG. 1, the imaging forming units 43Y, 43M, 43C, and 43K are provided in the horizontal traveling portion of the above-described intermediate transfer belt 42 at predetermined intervals.

Among the imaging forming units 43Y, 43M, 43C, and 43K, the image forming unit 43Y is a unit which forms a yellow (Y) toner image and is provided at the position which is closest to the driven roller 41*b*.

The image forming unit 43M is a unit which forms a magenta (M) toner image and is provided at the position which is close to the driven roller 41*b* next to the image forming unit 43Y.

The image forming unit 43C is a unit which forms a cyan (C) toner image and is provided at the position which is close to the driven roller 41*b* next to the image forming unit 43M.

The image forming unit 43K is a unit which forms a black (K) toner image and is provided at the position which is the closest to the driving roller 41*a*.

As shown in FIG. 1, the above-described image forming units 43Y, 43M, 43C, and 43K includes a photoreceptor drum 43*a* (image carrier), a charging portion 43*b*, a laser scanning unit 43*c*, a developing unit 43*d*, and a cleaning unit 43*e* as components.

Moreover, in the imaging forming unit 43Y, 43M, 43C, and 43K, only the colors of the toner images are different from one another, and the components of each one are the same.

The photoreceptor drum 43*a* is a cylindrical member in which the circumferential surface is formed of a predetermined photoreceptor material (for example, amorphous silicon).

The charging portion 43*b* uniformly charges the circumferential surface (photosensitive surface) of the photoreceptor drum 43*a*.

The laser scanning unit 43*c* forms an electrostatic latent image on the photosensitive surface by radiating a laser beam on the charged photosensitive surface.

The developing unit 43*d* develops the electrostatic latent image, which is formed on the photosensitive surface, as a toner image by supplying the toner to the photosensitive surface.

The cleaning unit 43*e* scrapes the toner (residual toner) remaining on the circumferential surface of the photoreceptor drum 43*a* and delivers the scraped residual toner to the waste toner transport portion 45 as waste toner T.

The cleaning unit 43*e* includes a toner crushing member 64 and will be described in more detail below with reference to other drawings.

As shown in FIG. 1, four primary transfer rollers 44Y, 44M, 44C, and 44K are provided so as to correspond to the imaging forming units 43Y, 43M, 43C, and 43K, and are disposed so as to face the photoreceptor drums 43*a* of each of the image forming units 43Y, 43M, 43C, and 43K in a state where the intermediate transfer belt 42 is interposed between each of the primary transfer rollers and the photoreceptor drums.

In addition, a primary transfer bias (high voltage) is applied to each of the primary transfer rollers 44Y, 44M, 44C, and 44K. Each of the primary transfer rollers 44Y, 44M, 44C, and 44K transfers (primarily transfers) the toner image of each color to the intermediate transfer belt 42 due to the effect of the primary transfer bias, the color being formed on the photoreceptor drums 43*a* of each of the image forming units 43Y, 43M, 43C, and 43K.

The waste toner transport portion 45 is configured of a transport screw, a transport path which accommodates the transport screw, and the like. The waste toner transport portion 45 collects the residual toner which is scraped from the photoreceptor drums 43*a* by the cleaning units 43*e* of each of the image forming units 43Y, 43M, 43C, and 43K and transports the waste toner T to the waste toner bottle 46.

The waste toner bottle 46 is a container which accommodates and stores the waste toner T supplied from the waste toner transport portion 45, and is detachably attached to the main body of the multifunction machine.

As shown in FIG. 1, the waste toner bottle 46 is attached to the main body of the multifunction machine so that an accommodating port 46*b* (opening) which is provided above a head portion 46*a* is directed upward, and the waste toner bottle 46 accommodates the waste toner T which drops from the rear end of the waste toner transport portion 45 from the accommodating port 46*b*.

In addition, if the waste toner bottle 46 accommodates the waste toner T up to the full state, the waste toner bottle is removed by a user, the waste toner T which is the contents are discharged, and the waste toner bottle 46 is in an empty state and is attached again.

Furthermore, the waste toner bottle 46 in which the waste toner T is accommodated up to the full state is removed by the user, and a new waste toner bottle 46 may be attached.

The full detecting sensor 47 is an optical sensor which carries out the full state detection of the waste toner bottle 46 by radiating a predetermined amount of light (detection light) to the head portion 46*a* of the waste toner bottle 46.

That is, as shown FIG. 1, the full detection sensor 47 includes an infrared LED (Light Emitting Diode) 47*a* (light emitting element) which is provided at a position corresponding to the head portion 46*a* of the waste toner bottle 46, and a phototransistor 47*b* (light receiving element) which is disposed so as to face the infrared LED 47*a* while interposing the head portion 46*a* between the infrared LED 47*a* and the phototransistor 47*b*.

Transmission strength of the detection light which is radiated from the infrared LED 47*a* to the head portion 46*a* is detected by the phototransistor 47*b*, and thereby, whether or not the waste toner T in the waste toner bottle 46 is filled up to the position close to the head portion 46*a*, that is, whether or not the waste toner bottle 46 is full is detected.

If the waste toner T in the waste toner bottle 46 is filled up to the position close to the head portion 46*a*, since the detection light is blocked due to the waste toner T, the transmission strength of the light which is detected by the phototransistor 47*b* is decreased.

The full detection sensor 47 outputs signals which indicate the transmission strength of the detected light to the calculation control portion 6 as a detection signal.

The paper feeding cassette 48 is a container which accommodates a plurality of recording papers P having a predetermined shape and size, such as A4 size or B5 size, in an overlapping state.

The pickup roller 49 is a roller which is provided so as to bring into pressure-contact with the recording papers P in the upper portion of the paper feeding cassette 48 and takes out the recording papers P in the paper feeding cassette 48 one by one and discharges the recording paper to the transport roller 50.

The transport roller 50 is a roller which transports the recording paper P which is fed from the pickup roller 49 toward the register roller 51.

The register roller 51 is a roller which supplies the recording papers P supplied from the transport roller 50 to the secondary transfer roller 52 at a predetermined time.

The secondary transfer roller 52 is a roller which is disposed so as to face the driving roller 41*a* while interposing the intermediate transfer belt 42, and transfers (secondarily transfer) the toner image on the intermediate transfer belt 42 to the recording paper P.

A secondary transfer bias (high voltage) is applied to the secondary transfer roller 52, and the secondary transfer roller 52 transfers (secondarily transfer) the toner image on the intermediate transfer belt 42 to recording paper P by the effect of the secondary transfer bias.

The pair of fixing rollers 53 includes a heating roller 53*a* which includes a heater in the inner portion thereof and a pressure roller 53*b* which comes into pressure-contact with the heating roller 53*a*.

The pair of fixing rollers 53 heats and pressurizes the recording paper P by interposing the recording paper P to which the toner image of each color is transferred between the heating roller 53*a* and the pressure roller 53*b*, and fixes the toner image of each color to the recording paper P.

The paper discharging roller 54 is a roller which transports the recording paper P which is discharged from the pair of fixing rollers 53 toward the paper discharging tray 55.

The paper discharging tray 55 is an accommodating portion which accommodates and holds the recording paper P discharged from the paper discharging roller 54.

The communication portion 5 communicates with the external multifunction machine or the facsimile device through a telephone line based on the control signals input from the calculation control portion 6 and communicates with client computers or the like through a LAN (Local Area Network).

That is, the communication portion 5 includes both a communication function based on the facsimile specification such as G3 and a communication function based on the LAN specification, such as Ethernet (registered trademark).

The calculation control portion 6 includes a CPU (Central Processing Unit), a ROM (Read Only Memory), a RAM (Random Access Memory), an interface circuit which sends and receives various signals from each portion electrically interconnected, and the like.

The calculation control portion 6 controls the overall operation of the multifunction machine A by performing various kinds of calculation processing based on a control program stored in the ROM or communicating each portion.

In the multifunction machine A of the present embodiment configured as described above, for example, if the user sets the document on the ADF and instructs copying of the document by operating the operating display portion 1, the instruction signals related to the instruction are input from the operation display portion 1 to the calculation control portion 6.

As a result, the calculation control portion 6 makes the image read portion 2 sequentially read the document image on every page of the document and stores the document image data of the document image in the image data storage portion 3.

Moreover, the calculation control portion 6 generates bitmap image data corresponding to each toner color based on the document image data respectively, and makes the image forming portion 4 perform the image forming processing of the document image based on the bitmap image data.

That is, the calculation control portion 6 drives the pickup roller 49, and thereby, the pickup roller takes out the recording papers P in the paper feeding cassette 48 one by one and discharges the recording papers to the transport roller 50. In addition, the calculation control portion 6 drives the transport roller 50, and thereby, the transport roller transports the recording papers P toward the register roller 51.

Also, the calculation control portion 6 drives the driving roller 41*a* and puts the intermediate transfer belt 42 into running condition.

Additionally, the calculation control portion 6 drives each of the imaging forming units 43Y, 43M, 43C, and 43K, which forms the toner image of each color on the photosensitive surface (circumferential surface) of each photoreceptor drum 43*a* based on each bitmap image data described above.

Moreover, the calculation control portion 6 applies the primary transfer bias to each of the primary transfer rollers 44Y, 44M, 44C, and 44K, and thereby, each of the primary transfer rollers primarily transfers the toner image of each photoreceptor drum 43*a* to the intermediate transfer belt 42.

In addition, the calculation control portion 6 drives the register roller 51 in accordance with the processing timing of the image forming of each color in the image forming units 43Y, 43M, 43C, and 43K.

Moreover, the calculation control portion 6 applies the secondary transfer bias to the secondary transfer roller 52, and thereby, the secondary transfer roller secondarily transfers the toner image (document image) on the intermediate transfer belt 42 to a desired position of the recording paper P.

In addition, the calculation control portion 6 drives the pair of the fixing rollers 53 and the paper discharging roller 54, and thereby, the fixing rollers fix the toner image to the recording paper P, and the discharging roller discharges the recording paper to the paper discharging tray 55.

Next, the cleaning unit 43*e* of the photoreceptor unit which includes a characteristic portion of the multifunction machine A of the present embodiment will be described with reference to FIGS. 2A to 7.

Figure 2A:
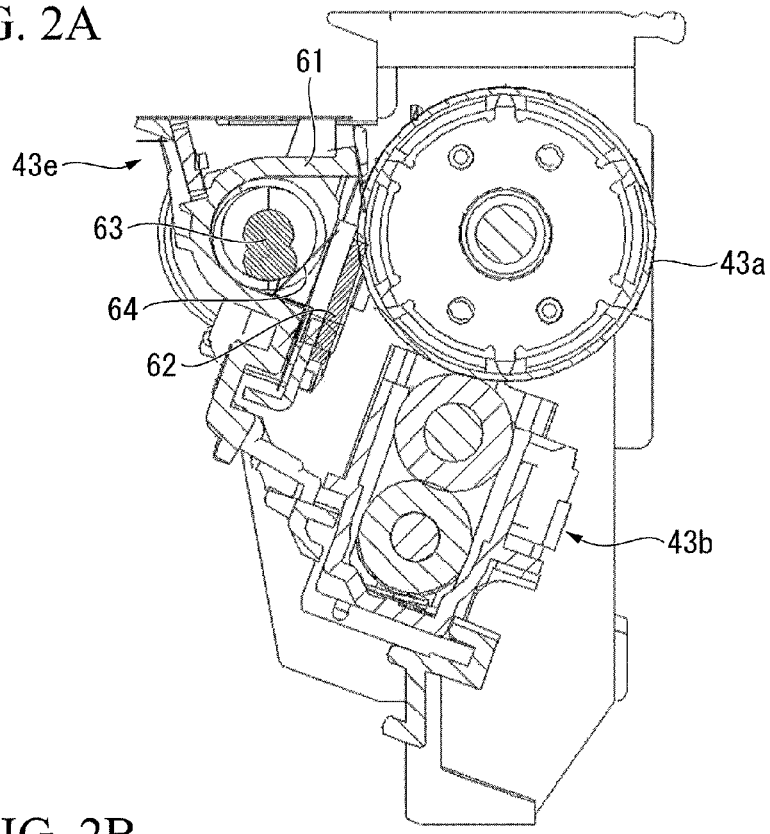
FIG. 2A is a longitudinal cross-sectional view of a photoreceptor unit which includes a cleaning unit which is included in the multifunction machine in an embodiment of the present disclosure.
Figure 2B:
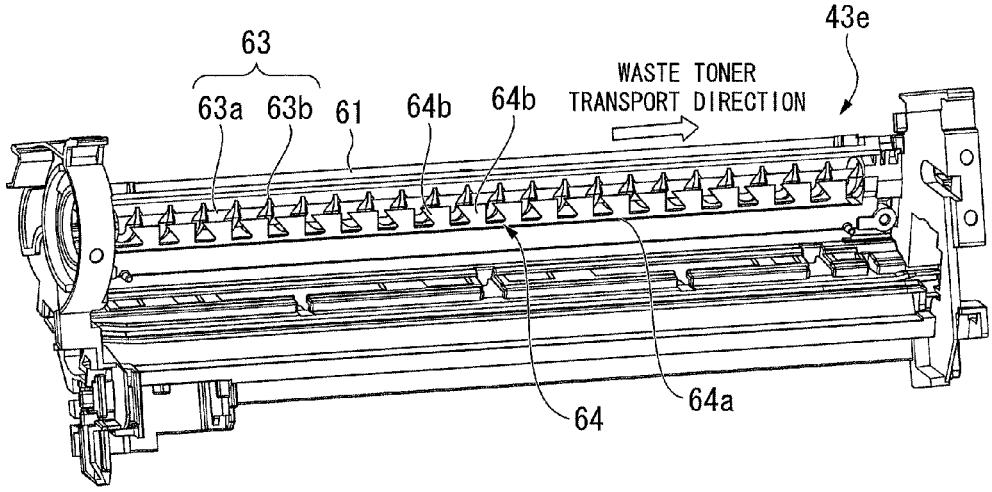
FIG. 2B is a perspective view of the photoreceptor unit including the cleaning unit which is included in the multifunction machine in an embodiment of the present disclosure.

FIG. 2A is a longitudinal cross-sectional view of the photoreceptor unit which includes the cleaning unit 43*e* and FIG. 2B is a perspective view of the photoreceptor unit which includes the cleaning unit 43*e*.

Figure 3:
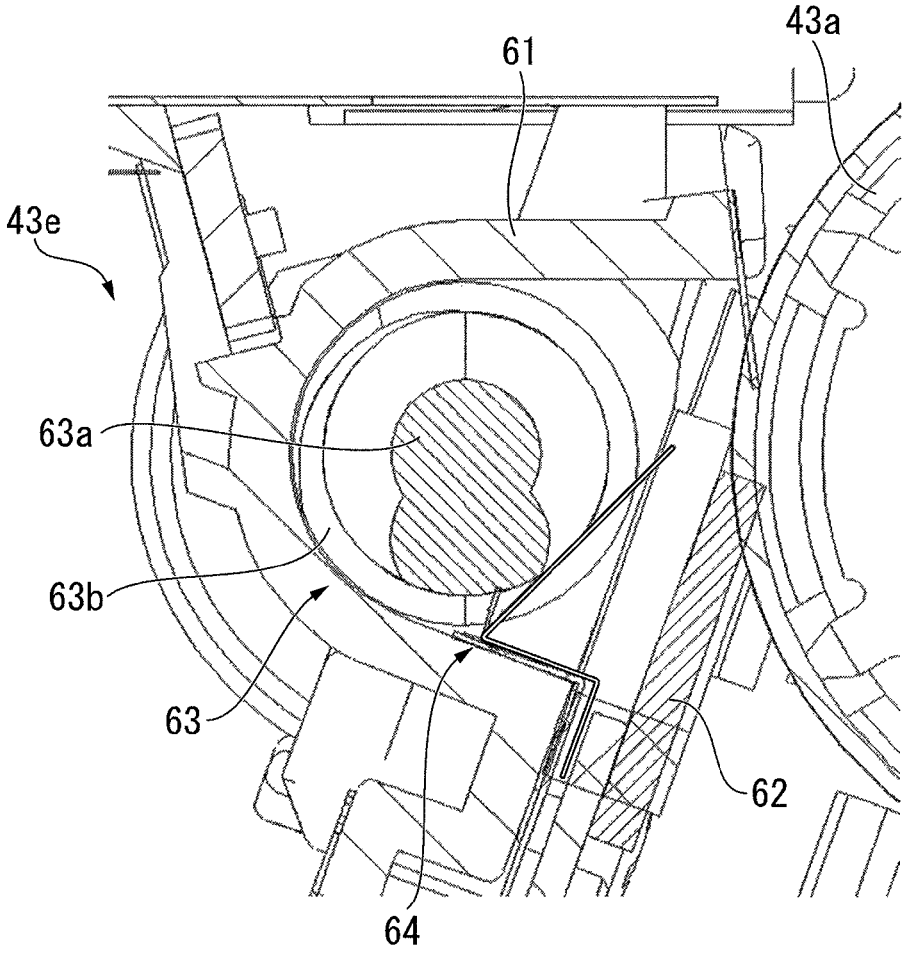
FIG. 3 is a longitudinal cross-section view in which the cleaning unit which is included in the multifunction machine in an embodiment of the present disclosure is enlarged.

In addition, FIG. 3 is a longitudinal cross-section view in which the cleaning unit 43*e* is enlarged.

Moreover, a cleaning blade 62 and the photoreceptor drum 43*a* are omitted in FIG. 2B.

As shown in FIG. 2A to 3, the cleaning unit 43*e* is disposed in the lateral side of the photoreceptor drum 43*a*, and includes a frame 61, a cleaning blade 62, a screw 63, and a toner crushing member 64.

Moreover, among components of the cleaning unit 43*e*, the screw 63 and the toner crushing member 64 configures a waste toner transporting device (toner transporting device) of the present disclosure.

That is, in the present embodiment, the function of the waste toner transporting device of the present disclosure is incorporated in the inner portion of the cleaning unit 43*e*.

The inner portion of the frame 61 becomes the transportation path of the waste toner T, and the frame 61 is an approximately cylindrical container which accommodates the screw 63 and the toner crushing member 64 in the inner portion of the frame.

In addition, an opening for introducing the waste toner T scraped from the photoreceptor drum 43*a* to the inner portion of the frame is provided in the side portion of the photoreceptor drum 43*a* side of the frame 61.

Such a frame 61 is fixed to a rigid member which becomes the framework of the multifunction machine A.

The cleaning blade 62 is disposed in the opening portion of the frame 61 so as to come into frictional contact with the circumferential surface of the photoreceptor drum 43*a*, and scrapes the residual toner which remains in the circumferential surface of the photoreceptor drum 43*a*.

The screw 63 transports the residual toner scraped using the cleaning blade 62 up to the waste toner transport portion 45 as the waste toner T.

The screw 63 includes a shaft portion 63*a* which is rotatably pivoted to the frame 61, and a spiral fin 63*b* which is wound around the shaft portion.

Moreover, in the present embodiment, the fin 63*b* is wound in the clockwise direction when viewed from the direction shown in FIG. 3, and the screw 63 is rotated in the clockwise direction when viewed from the direction shown in FIG. 3 by a driving mechanism (not shown).

As a result, the fin 63*b* is apparently moved in the waste toner transport direction shown in FIG. 2B, and the waste toner T is also transported in the axial direction of the screw 63 according to the movement of the fin 63*b*.

Figure 4A:
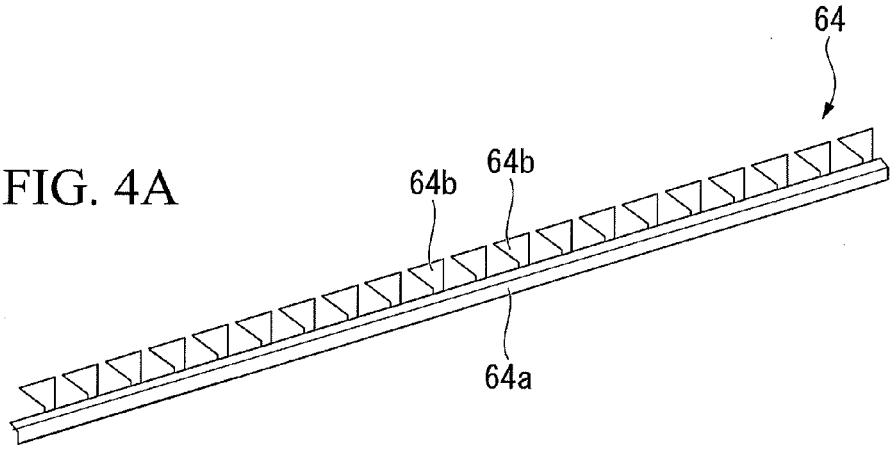
FIG. 4A is a perspective view of a toner crushing member which is included in the multifunction machine in an embodiment of the present disclosure.
Figure 4B:
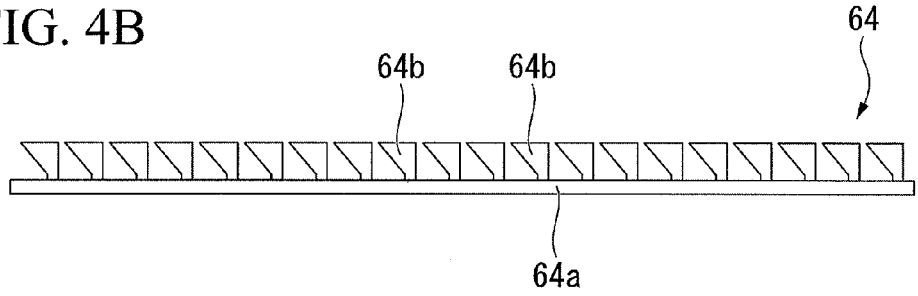
FIG. 4B is a front view of the toner crushing member which is included in the multifunction machine in an embodiment of the present disclosure.
Figure 4C:
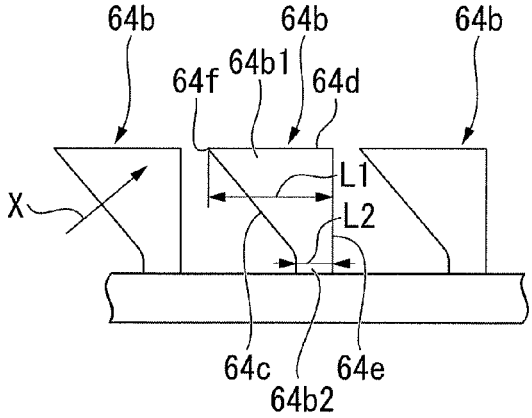
FIG. 4C is an enlarged view in which a portion of the toner crushing member which is included in the multifunction machine in an embodiment of the present disclosure is enlarged.

FIGS. 4A to 4C are views showing the toner crushing member 64, FIG. 4A is the perspective view thereof, FIG. 4B is the front view thereof, and FIG. 4C is an enlarged view in which a portion of the toner crushing member 64 is enlarged.

As shown in FIG. 4A to 4C, the toner crushing member 64 includes a long base portion 64*a* which extends in the axial direction of the screw 63 and a plurality of flexible plate members 64*b* which are disposed at equal intervals in the longitudinal direction of the base portion 64*a*.

The toner crushing member 64 is disposed between the cleaning blade 62 and the screw 63, the flexible plate member 64*b* is deformed according to the movement of the fin 63*b* of the screw 63, and thereby, the accumulated waste toner T is crushed.

The base portion 64*a* is bent in an L shape when viewed from the longitudinal direction and fixed to the frame 61.

For example, the base portion 64*a* is formed of polyethylene terephthalate (PET), and the base portion 64*a* is attached to the frame 61 using an adhesive.

As shown in FIGS. 4A to 4C, the flexible plate member 64*b* is a plate member having an approximately triangular shape which is pointed toward the upstream side in the waste toner transport direction (the transport direction of the waste toner T due to the screw 63), and the flexible plate member includes an inclined side 64*c* which is toward the base portion 64*a* side and an upper side 64*d* which is parallel with respect to the base portion 64*a*.

The inclined side 64*c* is configured so as to be perpendicular in the extension direction X of the fin 63*b* so that the flexible plate member 64*b* is not rolled up in the fin 63*b* when the fin 63*b* is rotated.

The flexible plate member 64*b* has a shape which spreads in the height direction (the direction perpendicular in the extension direction of the base portion 64*a*) from the upstream side toward the downstream side in the waste toner transport direction.

Similar to the base portion 64*a*, the flexible plate member 64*b* is formed of polyethylene terephthalate (PET), and thereby, the flexible plate member 64*b* has flexibility.

Moreover, other sheets made of resin such as Teflon (registered trademark) or Kapton (registered trademark) may be adopted as the material of the flexible plate member 64*b*, as long as they have flexibility. However, from the viewpoints of cost and durability, polyethylene terephthalate (PET) is more preferable.

In the flexible plate member 64*b*, the downstream side end 64*e* in waste toner transport direction is fixed to the base portion 64*a*.

Additionally, in the flexible plate member 64*b*, the upstream side end 64*f* is separated from the base portion 64*a*, the downstream side end 64*e* is fixed to the base portion 64*a*, and thereby, the upstream side end is supported so as to be connected to the base portion 64*a* in a standing position.

In addition, the flexible plate members 64*b* are arranged along the shaft portion 63*a* of the screw 63, and the upper portion of the flexible plate member 64*b* is disposed so as to bump into and contact the fin 63*b*.

Figure 5A:
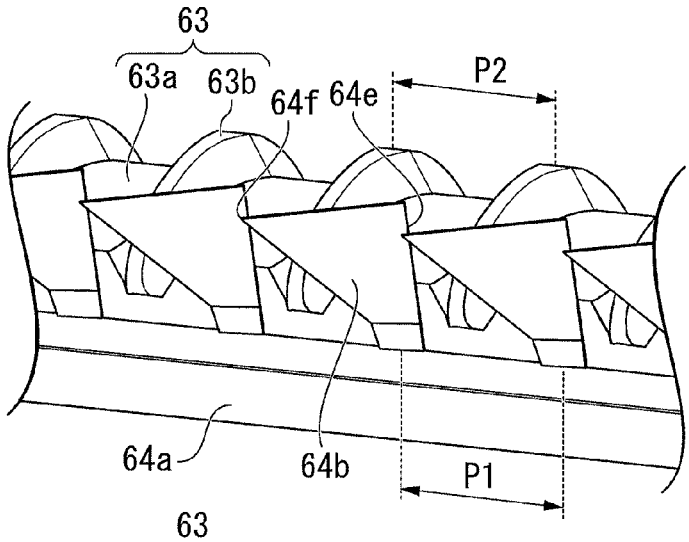
FIG. 5A is a perspective view showing a portion of a screw and the toner crushing member which are included in the multifunction machine in an embodiment of the present disclosure, in which a fin bumps into and contacts the upstream side end of a flexible plate member.
Figure 5B:
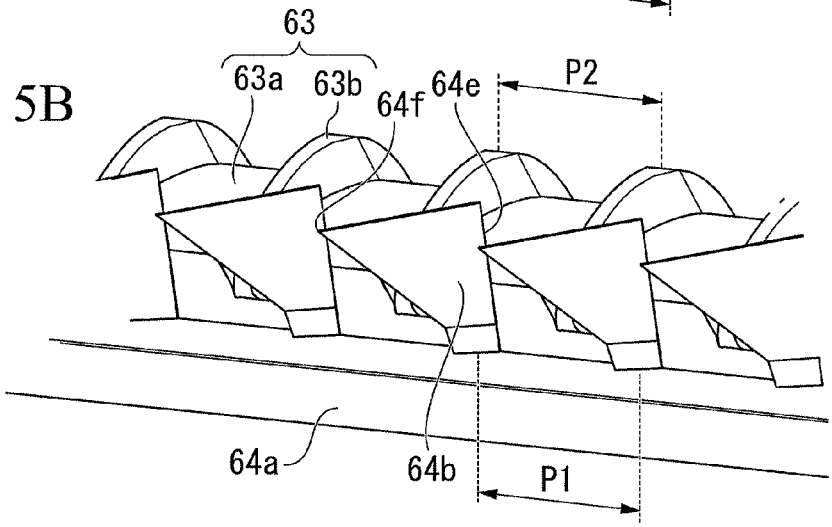
FIG. 5B is a perspective view showing a portion of the screw and the toner crushing member which are included in the multifunction machine in an embodiment of the present disclosure, in which the fin abuts between the upstream side end and the downstream side end of the flexible plate member.
Figure 5C:
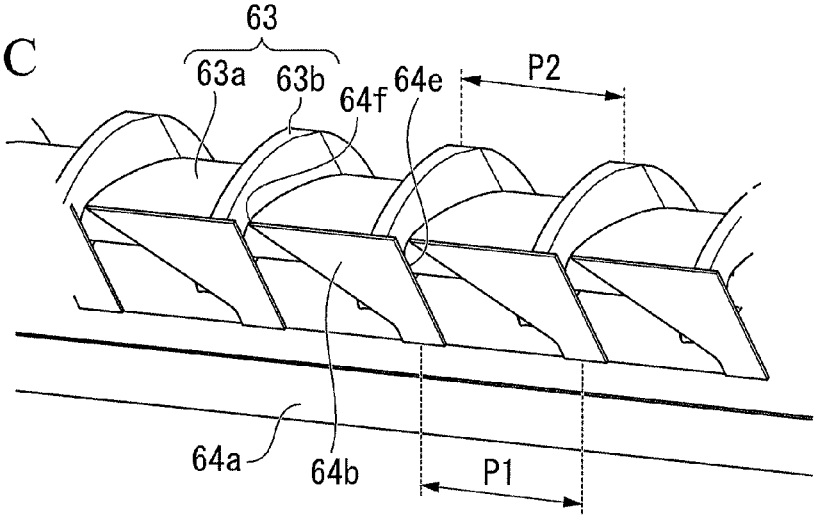
FIG. 5C is a perspective view showing a portion of the screw and the toner crushing member which are included in the multifunction machine in an embodiment of the present disclosure, in which the fin abuts between the downstream side end of the flexible plate member.

The placement pitch P1 of the flexible plate members 64*b* is set so as to be approximately 1 mm smaller than the helical pitch P2 of the fin 63*b* of the screw 63 (refer to FIGS. 5A to 5C).

That is, the placement pitch P1 of the flexible plate members 64*b* and the helical pitch P2 are different from each other.

Also, the placement pitch P1 as used herein means the distance between the flexible plate members 64*b* which are disposed so as to be adjacent in the axial direction of the screw 63.

In addition, the helical pitch P2 as used herein means the gap in which the first turned portion and the second turned portion (adjacent portions) of the fin 63*b* are separated from each other in the axial direction of the screw 63.

Next, the movement of the flexible plate member 64*b* of the toner crushing member 64 will be described with reference to FIGS. 5A to 5C and 6A to 6C.

Moreover, FIGS. 5A to 5C are perspective views showing a portion of the screw 63 and the toner crushing member 64, and shows a time-sequential change state in the order of FIGS. 5A, 5B, and 5C.

FIG. 5A shows a state where the fin 63*b* bumps into and contacts the upstream side ends 64*f* of the flexible plate members 64*b*.

Moreover, FIG. 5B shows a state where the fin 63*b* bumps into and contacts between the upstream side ends 64*f* and the downstream side ends 64*e* of the flexible plate members 64*b*.

In addition, FIG. 5C shows a state where the fin 63*b* bumps into and contacts the downstream side ends 64*e* of the flexible plate members 64*b*.

Figure 6A:
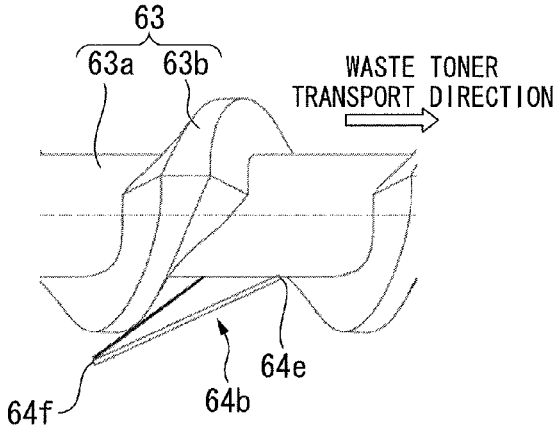
FIG. 6A is a plan view showing a portion of FIG. 5A.
Figure 6B:
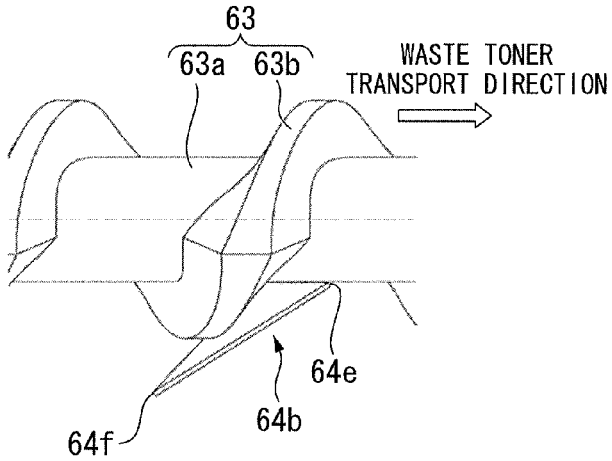
FIG. 6B is a plan view showing a portion of FIG. 5B.
Figure 6C:
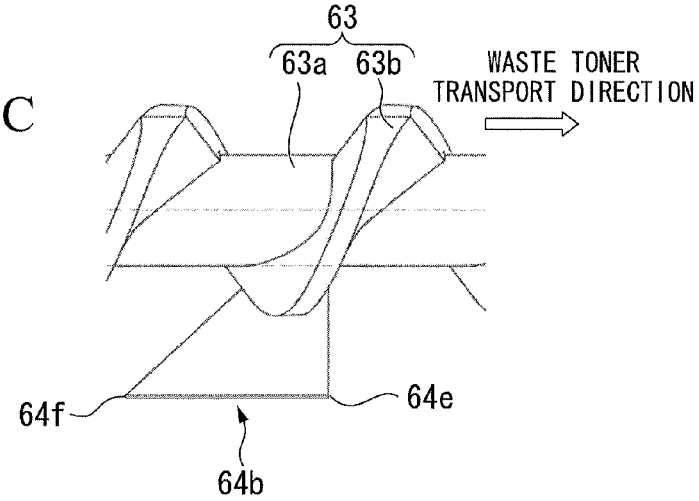
FIG. 6C is a plan view showing a portion of FIG. 5C.

Furthermore, FIGS. 6A to 6C are plan views in which only one flexible plate member 64*b* shown in FIGS. 5A to 5C is enlarged, FIG. 6A corresponds to FIG. 5A, FIG. 6B corresponds to FIG. 5B, and FIG. 6C corresponds to FIG. 5C.

As shown in FIGS. 5A and 6A, if the spiral fin 63*b* bumps into and contact the flexible plate member 64*b* from the upstream side, because the upstream side end 64*f* of the flexible plate member 64*b* is separated from the base portion 64*a*, the upstream side end 64*f* of the flexible plate member 64*b* greatly moves in the radial direction of the shaft portion 63*a* of the screw 63.

As a result, the flexible plate member 64*b* is greatly inclined in the direction in which the upstream side is separated from the screw 63, and the flexible plate member 64*b* is twisted with the downstream side fixed to the base portion 64*a* as the supporting point.

In addition, as shown in FIGS. 5B and 6B, if the fin 63*b* further moves in the transport direction of the waste toner T, the downstream side end 64*e* is gradually inclined in the direction separating from the screw 63 as the fin 63*b* approaches the downstream side end 64*e* of the flexible plate member 64*b*.

As a result, if the twist of the flexible plate member 64*b* is gradually removed and the fin 63*b* reaches the downstream side end 64*e* of the flexible plate member 64*b*, as shown in FIGS. 5C and 6C, the twist of the flexible plate member 64*b* is removed.

While the screw 63 rotates, the plurality of fins 63*b* apparently advance from the upstream side to the downstream side in the transport direction of the waste toner T.

Consequently, the fin 63*b* bumps into and contacts the flexible plate member 64*b* repeatedly from the upstream side.

Therefore, the flexible plate member 64*b* repeats the waving movement so as to flap from the upstream side toward the downstream side.

In this way, the flexible plate member 64*b* repeats the waving movement so as to flap from the upstream side toward the downstream side, and thereby, the waste toner T is also moved from the upstream side to the downstream side due to the movement of the flexible plate member 64*b*.

In the cleaning unit 43*e*, the rotating screw 63 transports the residual toner, which is scraped from the circumferential surface of the photoreceptor drum 43*a* by the cleaning blade 62, up to the waste toner transport portion 45.

Moreover, in the cleaning unit 43*e*, due to the deformation of the flexible plate member 64*b*, the waste toner T which has accumulated around the screw 63 is crushed, and the waste toner T is transported toward the waste toner transport portion 45.

In this way, in the present embodiment, the waste toner T is transported toward the downstream side by both the screw 63 and the toner crushing member 64.

Therefore, the movement of the above flexible plate member 64*b* can supplement the decrease in the transportability of the waste toner T due to the placement of the toner crushing member 64.

As a result, the transportability of the waste toner T is maintained well.

Moreover, the waste toner T which is accumulated around the screw is crushed by the movement of flexible board member 64*b* being repeated.

Therefore, according to the multifunction machine A of the present embodiment, the accumulated waste toner T can be crushed without requiring complicated mechanisms such as a striking mechanism or a decreasing of the transportability of the waste toner T.

Moreover, in the multifunction machine A of the present embodiment, the plurality of flexible plate members 64*b* are provided along the shaft portion 63*a* of the screw 63.

Therefore, while the accumulation of the waste toner T is crushed over the entire region in the longitudinal direction of the screw 63 by the flexible plate member 64, the waste toner T can be transported.

Furthermore, in the multifunction machine A of the present embodiment, the placement pitch P1 of the flexible plate members 64*b* and the helical pitch P2 are different from each other.

Figure 7:
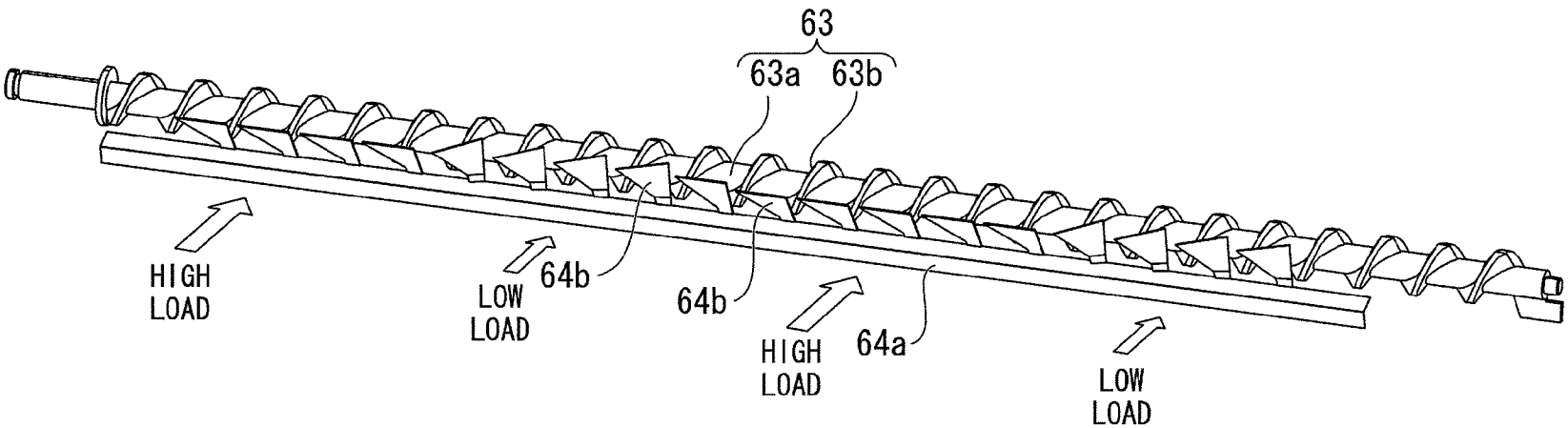
FIG. 7 is a perspective view showing the screw and the toner crushing member which is included in the multifunction machine in an embodiment of the present disclosure.

Therefore, as shown in FIG. 7, the timing of the deformation of the flexible plate member 64*b* is shifted in the longitudinal direction of the screw 63.

That is, as shown in FIG. 7, the plurality of installed flexible plate members 64*b* are deformed so as to wave.

The load which the screw 63 receives from flexible plate members 64*b* is changed according to posture (inclination) of the flexible board member 64*b*.

In addition, the plurality of flexible plate members 64*b* are deformed so as to wave, and thereby, all the postures of the flexible plate members 64*b* being the same can be avoided, the loads which receive from the flexible plate members 64*b* can be different from one another at every portion in the longitudinal direction of the screw 63.

As a result, large load acting on the screw 63 at a time is prevented, and it is possible to prevent the screw 63 from being bent.

Also, the above-mentioned wave advances towards the transport direction of the waste toner T.

As a result, due to the advance of the wave, the waste toner T can be transported and the transportability of the waste toner T can be improved.

Moreover, since the above-described wave is generated due to the fact that the placement pitch P1 of the flexible plate members 64*b* and the helical pitch P2 are different from each other, the wave can be formed even when the placement pitch P1 of the flexible plate members 64*b* is greater than the helical pitch P2.

However, since it is considered that the transportability of the waste toner T can be improved in the case where many flexible board members 64*b* are installed, it is preferable that the placement pitch P1 of the flexible plate members 64*b* be smaller than the helical pitch P2.

In addition, in the multifunction machine A of the present embodiment, the length in the height direction of the flexible plate member 64*b* increases from the upstream side toward the downstream side in the transport direction of the waste toner T.

Therefore, as shown in FIG. 4C, a large interval can be formed between the inclined side 64*c* and the base portion 64*a*, and the waste toner T can be smoothly supplied from the cleaning blade 62 to the screw 63.

As described above, the preferred embodiment of the present disclosure are described with reference to the accompanying drawing. However, the present disclosure is not limited to the embodiment.

The shape, the combination, or the like of each component shown in the above-described embodiment is an example, and various modifications can be performed based on the design requirements and the like within the scope without departing from the gist of the present disclosure.

For example, in the embodiment, the configuration is described in which the flexible plate member 64*b* has a triangular shape which spreads in the height direction from the upstream side toward the downstream side in the transport direction of the waste toner T.

Figure 8A:
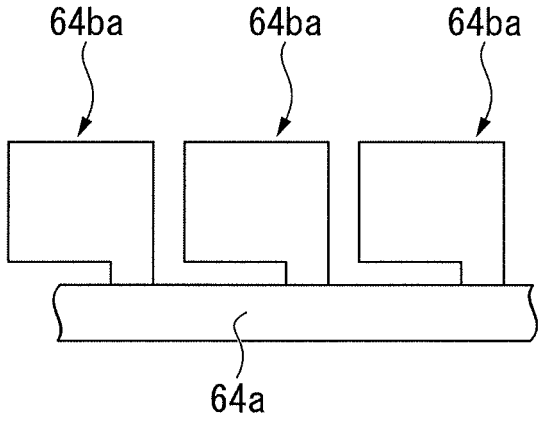
FIG. 8A shows a modification of the multifunction machine in an embodiment of the present disclosure and is a front view showing a portion of a toner crushing member which includes a rectangular flexible plate member.

However, the present disclosure is not limited to the triangular shape, and as shown in FIG. 8A, a rectangular flexible plate member 64*a* can be used.

Figure 8B:
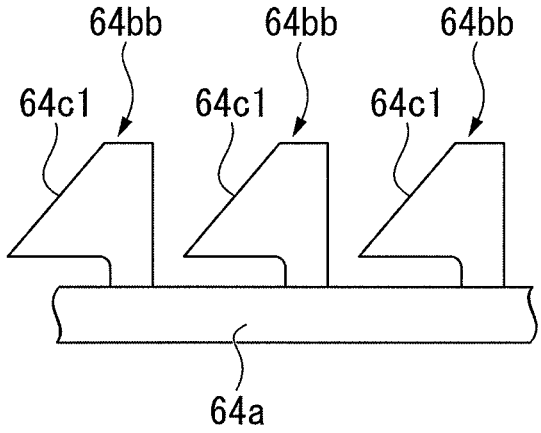
FIG. 8B shows a modification of the multifunction machine in an embodiment of the present disclosure and is a front view showing a portion of a toner crushing member which includes an approximately triangular flexible plate member in which an inclined side is toward the side opposite to a base portion.

Moreover, as shown in FIG. 8B, a flexible plate member 64*bb* including an inclined side 64*c*1 which is toward the side opposite to the base portion 64*a* can be used.

Second Embodiment

Hereinafter, a second embodiment of the image forming apparatus according to the present disclosure will be described with reference to the drawings.

Also, in the drawings below, the scale of each member is appropriately changed for the size of each member to be recognizable.

Furthermore, the same reference numerals are given to the components common to the first embodiment in FIGS. 1 to 7, and the detailed descriptions thereof are omitted.

Hereinafter, only configuration and operation which are different from the first embodiment are described.

In the second embodiment of the image forming apparatus according to the present disclosure, the base portion 64*a* of the toner crushing member 64 is fixed to the frame 61 in the rear side (screw side) of the installation location of the cleaning blade 62.

For example, the base portion 64*a* is formed of polyethylene terephthalate (PET), and the base portion 64*a* is attached to the frame 61 using adhesive.

The base portion 64*a* biases the flexible plate member 64*b* toward the screw 63.

As shown in FIG. 4A to 4C, the flexible plate member 64*b* is a plate member having an approximately triangular shape which is pointed toward the upstream side in the waste toner transport direction (the transport direction of the waste toner T due to the screw 63), and the flexible plate member includes the inclined side 64*c* which is toward the base portion 64*a* side and the upper side 64*d* which is parallel with respect to the base portion 64*a*.

The inclined side 64*c* is configured so as to be perpendicular in the extension direction X of the fin 63*b* so that the flexible plate member 64*b* is not rolled up in the fin 63*b* when the fin 63*b* is rotated.

The flexible plate member 64*b* has a shape in which the length in the height direction (the direction perpendicular in the extension direction of the base portion 64*a*) from the upstream side toward the downstream side in the waste toner transport direction increases.

As a result, in the flexible plate member 64*b*, the width L1 of a tip portion 64*b*1 is larger than the width L2 of a root portion 64*b*2.

That is, the present embodiment, the flexible board member 64*b* includes the root portion 64*b*2 which is fixed to the base portion 64*a* and the tip portion 64*b*1 in which the width is wider than that of the root portion 64*b*2 in the transport direction of the waste toner T in the screw 63.

In addition, similar to the base portion 64*a*, the flexible plate member 64*b* is formed of polyethylene terephthalate (PET), and thereby, the flexible plate member 64*b* has flexibility.

Moreover, other sheets made of resin such as Teflon (registered trademark) or Kapton (registered trademark) may be adopted as the material of the flexible plate member 64*b*, as long as they have flexibility. However, from the viewpoints of cost and durability, the polyethylene terephthalate (PET) is more preferable.

In the flexible plate member 64*b*, the downstream side end 64*e* in waste toner transport direction is fixed to the base portion 64*a*, the upstream side end 64*f* is separated from the base portion 64*a*, the downstream side end 64*e* is fixed to the base portion 64*a*, and thereby, the upstream side end is supported so as to be erected to the base portion 64*a*.

In addition, the flexible plate members 64*b* are arranged along the shaft portion 63*a* of the screw 63, and the tip portion 64*b*1 side is disposed so as to bump into and contact the fin 63*b*.

The placement pitch P1 of the flexible plate members 64*b* is set so as to be approximately 1 mm smaller than the helical pitch P2 of the fin 63*b* of the screw 63 (refer to FIGS. 5A to 5C).

That is, the placement pitch P1 of the flexible plate members 64*b* and the helical pitch P2 are different from each other.

Moreover, the placement pitch P1 as used herein means the distance between the flexible plate members 64*b* which are disposed so as to be adjacent in the axial direction of the screw 63.

In addition, the helical pitch P2 as used herein means the gap in which the first turned portion and the second turned portion (adjacent portions) of the fin 63*b* are separated from each other in the axial direction of the screw 63.

Furthermore, in the present embodiment, the flexible plate members 64*b* are fixed to the base portion 64*a* which extends along the shaft portion 63*a* of the screw 63, and the width of the root portion 64*b*2 of the flexible plate member 64*b* are set so as to be narrower than the width of the tip portion 64*b*1 in the transport direction of the toner T (the extension direction of the shaft portion 63*a*) in the screw 63.

According to the flexible plate members 64*b* of the present embodiment, the toner T can be crushed over a wide range by the tip portion 64*b*1.

Moreover, since a wide space through which the toner T can pass can be secured around the root portion 64*b*2, the toner can be smoothly supplied to the screw 63.

Therefore, according to the present embodiment, the accumulated toner T can be crushed over a wide range while the decrease in the transportability of the toner T is suppressed.

Moreover, in the present embodiment, the plurality of flexible plate members 64*b* are provided while being separated from one another along the shaft portion 63*a* of the screw 63.

Therefore, accumulation of the waste toner T can be crushed over the entire region in the longitudinal direction of the screw 63 by the flexible plate member 64.

In addition, in the present embodiment, the base portion 64*a* biases the flexible plate member 64*b* toward the screw 63.

Thereby, when the flexible plate member 64*b* is deviated from the fin 63*b* due to the apparent movement of the fin 63*b*, the flexible plate member 64*b* which is deformed due to the fin 63*b* so far is restored to the original shape with great force.

As a result, it is possible to crush the accumulated toner T more reliably.

Furthermore, when the flexible plate member 64*b* is to be restored to the original shape, the greater the bending of the flexible plate member 64*b* at the time of bumping into and contacting the fin 63*b*, the greater the impact force which is applied to the toner T.

Therefore, it is preferable that the locations of the flexible plate member 64*b* within one-third from the tip in the height direction contact the fin 63*b* of the screw 63.

For example, when the height of the flexible plate member 64*b* is 10 mm, the location of 3 mm from the tip of the flexible plate member 64*b* is set so as to bump into and contact the fin 63*b*.

Figure 9:
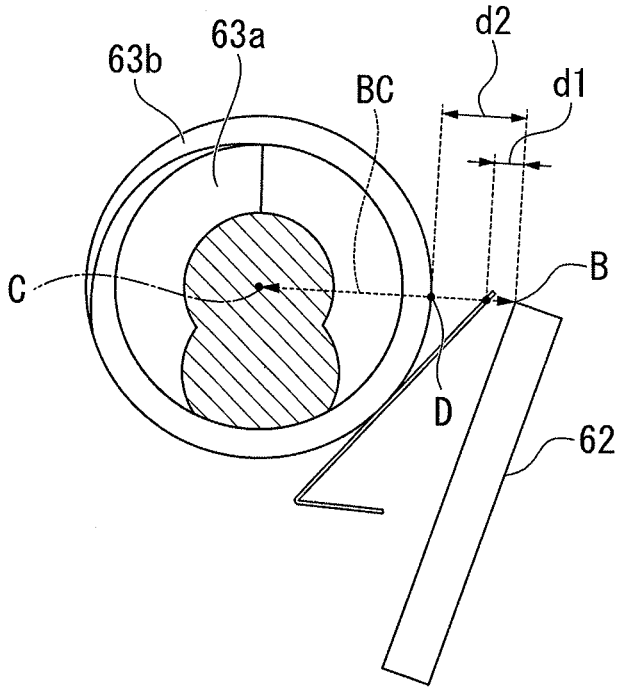
FIG. 9 shows a modification of the multifunction machine in an embodiment of the present disclosure and is a schematic view showing a cleaning blade, a screw, and a toner crushing member.

In addition, when the flexible plate member 64*b* is deformed to the maximum due to the fin 63, as shown in FIG. 9, in the longitudinal cross-section of the photoreceptor unit, on a line segment BC which connects the tip B of the cleaning blade 62 and the rotation center C of the screw 63, it preferable that a distance d1 from the tip B of the cleaning blade 62 to the flexible plate member 64*b* be shorter than one-third of a distance d2 from the tip B of the cleaning blade 62 to the intersection of the line segment BC and the tip D of the fin 63*b*.

Therefore, the bending of the flexible plate member 64*b* when the flexible plate member bumps into and contact the fin 63*b* can be sufficiently increased, and the impact force which is applied to the toner T when the flexible plate member 64*b* is restored to the original shape can be sufficiently increased.

Additionally, in the present embodiment, the flexible plate member 64*b* has a shape which spreads in the height direction from the upstream side toward the downstream side.

As shown in FIG. 4C, a large interval can be formed between the inclined side 64*c* and the base portion 64*a*.

Accordingly, the waste toner T can be smoothly supplied from the cleaning blade 62 to the screw 63.

As described above, the preferred embodiments of the present disclosure are described with reference to the accompanying drawing. However, the present disclosure is not limited to the embodiment.

The shapes, the combinations, or the like of each component shown in the above-described embodiments are examples, and various modifications can be performed based on the design requirements and the like within the scope not departing from the gist of the present disclosure.

For example, in the embodiment, the configuration is described in which the flexible plate member 64*b* has a triangular shape which spreads in the height direction from the upstream side toward the downstream side in the transport direction of the waste toner T.

However, the flexible board member 64*b* in the present disclosure is not limited to such a shape. As shown in FIGS. 10A to 10D, other shapes can be adopted if the width of the tip portion is wider than the width of the root portion.

Figure 10A:
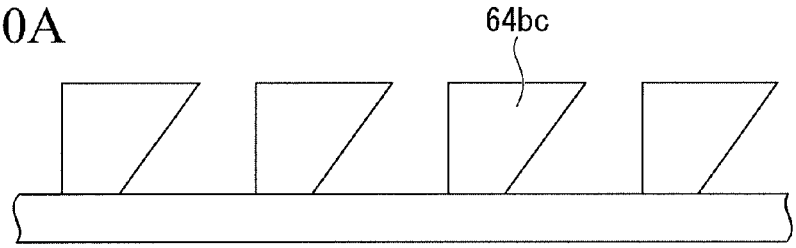
FIG. 10A shows a modification of the multifunction machine in an embodiment of the present disclosure and is a front view showing a flexible plate member including a triangular shape which spreads in the height direction from the downstream side toward the upstream side.

FIG. 10A shows a flexible plate member 64*bc* which has a triangular shape which spreads in the height direction from the downstream side toward the upstream side.

Figure 10B:
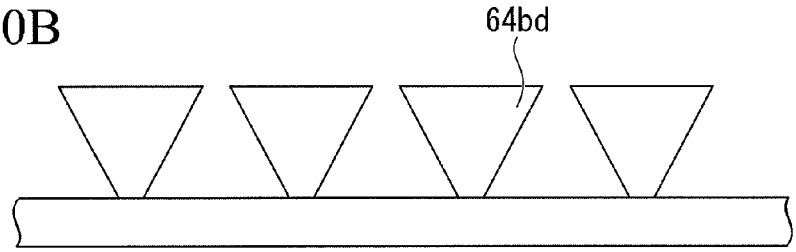
FIG. 10B shows a modification of the multifunction machine in an embodiment of the present disclosure and is a front view showing a flexible plate member which has an approximately inverted triangular shape.

FIG. 10B shows a flexible plate member 64*bd* which has an approximately inverted triangular shape.

Figure 10C:
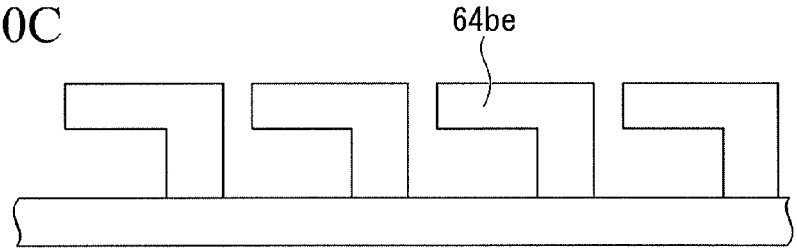
FIG. 10C shows a modification of the multifunction machine in an embodiment of the present disclosure and a front view showing a flexible plate member which is formed in a rectangular shape in which the widths of a tip portion and a root portion are different from each other.

FIG. 10C shows a flexible plate member 64*be* which is formed in a rectangular shape in which the widths of the tip portion and the root portion are different from each other.

Figure 10D:
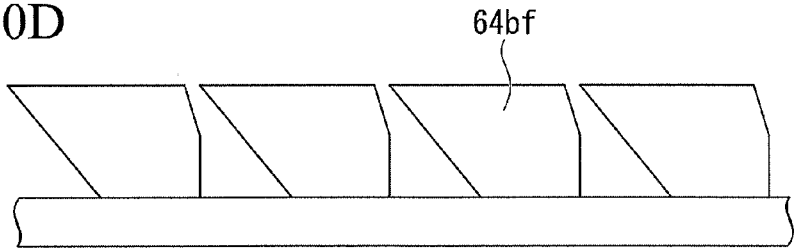
FIG. 10D shows a modification of the multifunction machine in an embodiment of the present disclosure and is a front view showing a flexible plate member which has a shape in which the upper edge of the downstream side of the flexible plate member shown in FIG. 4C is cut.

FIG. 10D shows a flexible plate member 64*bf* which has a shape in which the upper edge of the downstream side of the flexible plate member 64*b* of the embodiment is cut.

In the first and second embodiments, the configuration in which the image forming apparatus of the present disclosure is applied to the multifunction machine A for color printing is described.

However, the disclosure is not limited thereto, and the present disclosure may be applied to a printer, a facsimile device, or a multifunction machine for monochromatic printing.

Moreover, in the first and second embodiments, the configuration in which the toner transporting device of the present disclosure is incorporated in the inner portion of the cleaning unit 43*e* as the waste toner transporting device is described.

However, the present disclosure may be incorporated not only as the waste toner transporting device but also in a toner transporting device for transporting the toner to the developing unit 43*d* or a toner transporting device for transporting the toner to a toner container (not shown) which accommodates the toner supplied to the developing unit 43*d*.

While preferred embodiments of the disclosure have been described and illustrated above, it should be understood that these are exemplary of the disclosure and are not to be considered as limiting. Additions, omissions, substitutions, and other modifications can be made without departing from the scope of the present disclosure. Accordingly, the disclosure is not to be considered as being limited by the foregoing description, and is only limited by the scope of the appended claims.

What is claimed is:

1. A toner transporting device comprising:

a screw that includes a shaft portion and a spiral fin wound around the shaft portion, and the screw transports toner in an axial direction thereof; and a toner crushing member that is disposed along a transport direction of the toner and crushes accumulated toner, the toner crushing member comprising:

a base portion that extends along the shaft portion of the screw; and a flexible plate member which is disposed at a position at which the flexible plate member bumps into and contacts the spiral fin, and in which a downstream side of the flexible plate member in the transport direction of the toner in the screw is fixed to the base portion, and an upstream side of the flexible plate member in the transport direction of the toner in the screw is separated from the base portion, wherein in a state where the flexible plate member is maximally deformed due to the spiral fin, on a line segment connecting a tip of a cleaning blade which scrapes residual toner on an image carrier and a rotation center of the screw in a longitudinal cross-section of the image carrier, a distance from the tip of the cleaning blade to the flexible plate member is shorter than one-third of a distance from the tip of the cleaning blade to the intersection of the line segment and the tip of the spiral fin.

2. The toner transporting device according to claim 1, wherein a plurality of flexible plate members are provided along the shaft portion of the screw.

3. The toner transporting device according to claim 2, wherein a placement pitch of the flexible plate members is different from a helical pitch of the fin.

4. The toner transporting device according to claim 2, wherein the toner transporting device is a waste toner transporting device that transports the residual toner on the image carrier.

5. The toner transporting device according to claim 1, wherein a width of the flexible plate member increases in the height direction from the upstream side toward the downstream side.

6. The toner transporting device according to claim 1, wherein the toner transporting device is a waste toner transporting device that transports residual toner on an image carrier.

7. An image forming apparatus comprising the toner transporting device according to claim 1.

8. A toner transporting device comprising:

a screw that includes a shaft portion and a spiral fin wound around the shaft portion, and the screw transports toner in an axial direction thereof; and a toner crushing member that is disposed along a transport direction of the toner and crushes accumulated toner, the toner crushing member comprising:

a base portion that extends along the shaft portion of the screw; and a flexible plate member that is disposed at a position at which the flexible plate member bumps into and contacts the spiral fin, and comprises a root portion which is fixed to the base portion and a tip portion at which a width in the transport direction of the toner in the screw is wider than a width of the root portion, wherein in a state where the flexible plate member is maximally deformed due to the spiral fin, on a line segment connecting a tip of a cleaning blade which scrapes an residual toner on an image carrier and a rotation center of the screw in a longitudinal cross-section of the image carrier, a distance from the tip of the cleaning blade to the flexible plate member is shorter than one-third of a distance from the tip of the cleaning blade to the intersection of the line segment and the tip of the spiral fin.

9. The toner transporting device according to claim 8, wherein a plurality of flexible plate members are provided so as to be separated from one another along the shaft portion of the screw.

10. The toner transporting device according to claim 8, wherein the base portion biases the flexible plate member toward the screw.

11. The toner transporting device according to claim 8, wherein a width of the flexible plate member increases in the height direction from an upstream side of the flexible plate member toward an downstream of the flexible plate member.

12. The toner transporting device according to claim 8, wherein the locations of the flexible plate member within one-third from a tip of the flexible plate member in the height direction bump into and contact the screw.

13. The toner transporting device according to claim 8, wherein the toner transporting device is a waste toner transporting device that transports the residual toner on the image carrier.

14. An image forming apparatus comprising the toner transporting device according to claim 8.

* * * * *